US009937103B1

(12) United States Patent
Streit

(10) Patent No.: US 9,937,103 B1
(45) Date of Patent: Apr. 10, 2018

(54) EMESIS RECEPTACLE

(71) Applicant: Mark Streit, Sublette, IL (US)

(72) Inventor: Mark Streit, Sublette, IL (US)

( * ) Notice: Subject to any disclaimer, the term of this patent is extended or adjusted under 35 U.S.C. 154(b) by 80 days.

(21) Appl. No.: 15/208,061

(22) Filed: Jul. 12, 2016

(51) Int. Cl.
*A61J 19/02* (2006.01)
*A61J 19/00* (2006.01)
*B65D 25/28* (2006.01)
*B65D 25/14* (2006.01)

(52) U.S. Cl.
CPC ..... *A61J 19/00* (2013.01); *B65D 25/14* (2013.01); *B65D 25/282* (2013.01)

(58) Field of Classification Search
CPC ..... A61J 19/00; A61J 19/02
USPC ..... 220/507, 505, 908
See application file for complete search history.

(56) References Cited

U.S. PATENT DOCUMENTS 4,483,440 A * 11/1984 Ware ..... B65F 1/06 206/216
4,610,039 A 9/1986 Stern
5,971,969 A * 10/1999 Cashel ..... A61J 19/00 604/323
6,253,949 B1 7/2001 Dickson
D647,199 S 10/2011 Kroiss
8,875,930 B2 11/2014 Felicetti
2007/0045323 A1 3/2007 Kroiss
2008/0116205 A1* 5/2008 Forest ..... B65F 1/0006 220/495.1
2011/0144600 A1 6/2011 Shoemaker
2015/0114969 A1 4/2015 Martin

FOREIGN PATENT DOCUMENTS

WO 2007025179 A2 3/2007

* cited by examiner

*Primary Examiner* — Stephen Castellano

(57) ABSTRACT

The emesis receptacle is a container that is adapted for use in receiving and storing discharge of emesis. The emesis receptacle is designed to receive the discharge with a minimum of spillage. The emesis receptacle further provides storage areas for the purpose of containing domestic articles necessary for maintaining comfort and cleanliness throughout the discharge process. The emesis receptacle comprises a hollow container, a plurality of handles, one or more pockets, a drawer, a false bottom, and a chin extension. The plurality of handles, the chin extension, and the one or more pockets are attached to the container. The drawer is installed within the container. The false bottom is positioned within the container such that the false bottom protects the contents of the drawer from the discharge of emesis.

7 Claims, 3 Drawing Sheets

EMESIS RECEPTACLE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of medical and veterinary science and containers adapted for medical or pharmaceutical purposes, more specifically, a container adapted for use with spittle.

SUMMARY OF INVENTION

The emesis receptacle is a container that is adapted for use in receiving and storing discharge from emesis. The emesis receptacle is designed to receive the discharge with a minimum of spillage. The emesis receptacle further provides storage areas for the purpose of containing domestic articles necessary for maintaining comfort and cleanliness throughout the discharge process.

These together with additional objects, features and advantages of the emesis receptacle will be readily apparent to those of ordinary skill in the art upon reading the following detailed description of the presently preferred, but nonetheless illustrative, embodiments when taken in conjunction with the accompanying drawings.

In this respect, before explaining the current embodiments of the emesis receptacle in detail, it is to be understood that the emesis receptacle is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the emesis receptacle.

It is therefore important that the claims be regarded as including such equivalent construction insofar as they do not depart from the spirit and scope of the emesis receptacle. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
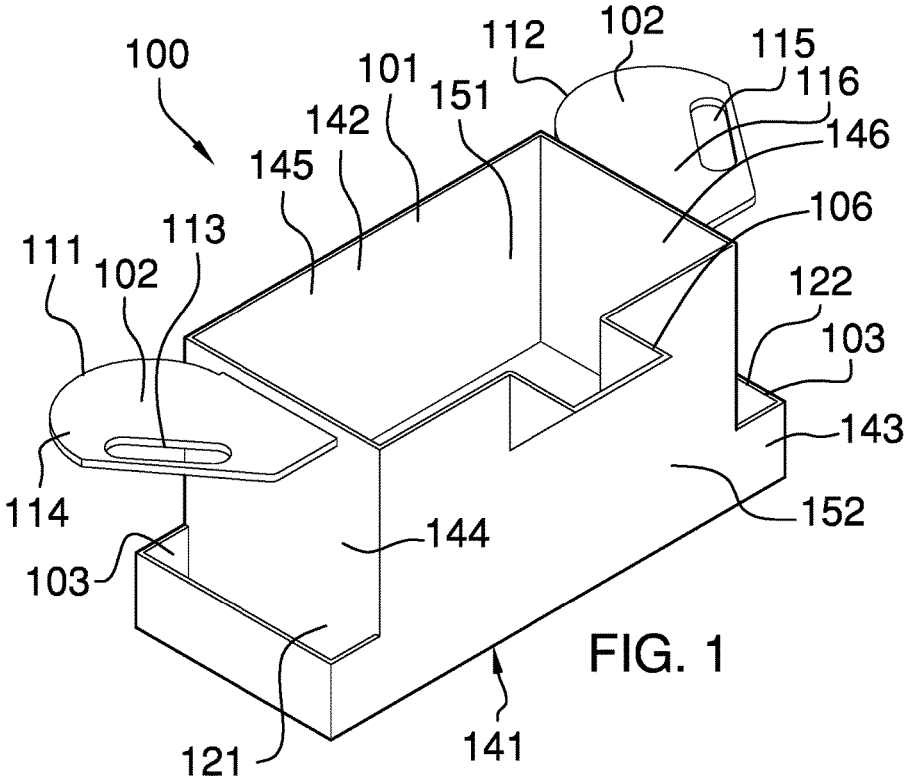
FIG. 1 is a perspective view of an embodiment of the disclosure.
Figure 2:
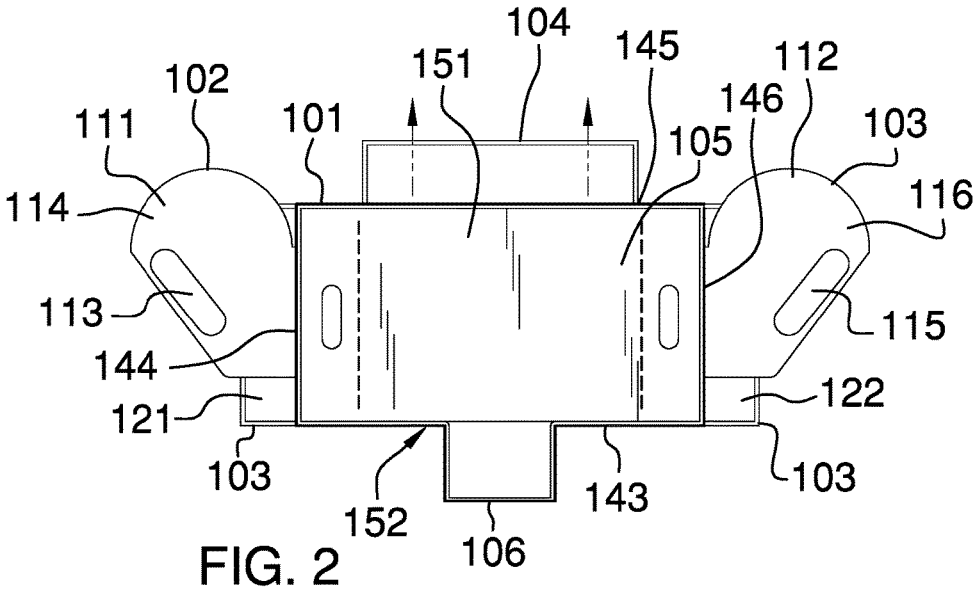
FIG. 2 is a top view of an embodiment of the disclosure.
Figure 3:
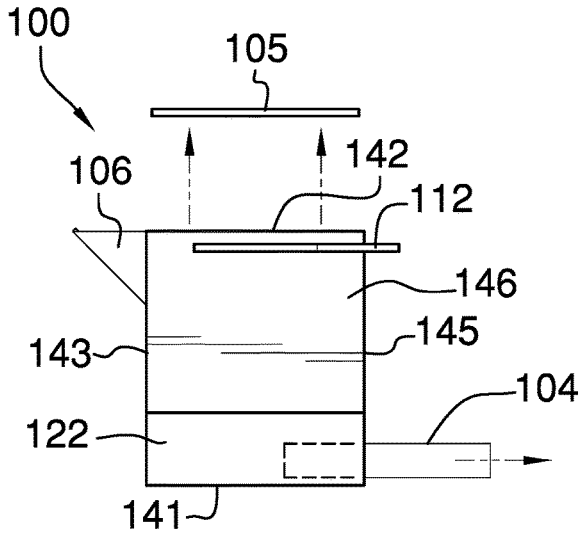
FIG. 3 is a side view of an embodiment of the disclosure.
Figure 4:
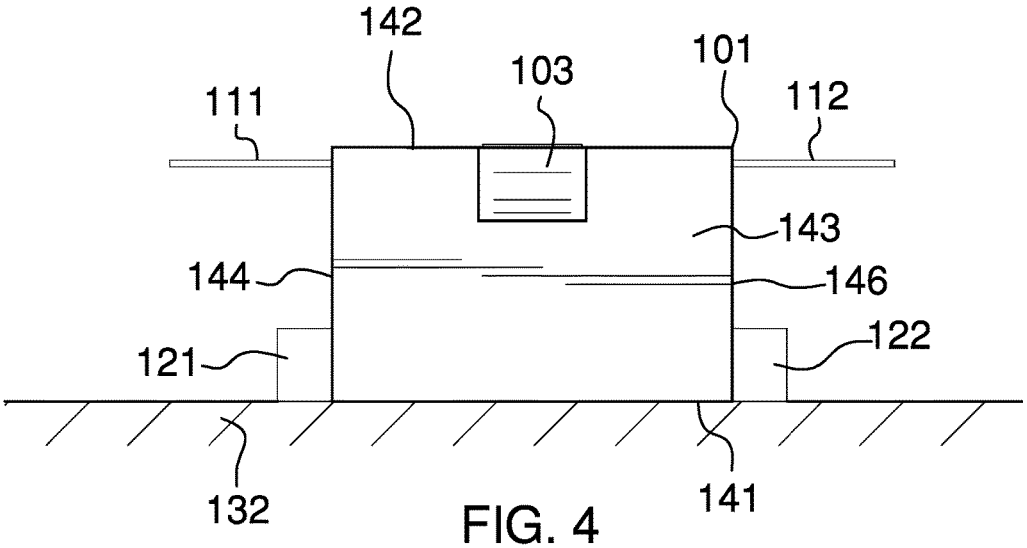
FIG. 4 is a front view of an embodiment of the disclosure.
Figure 5:
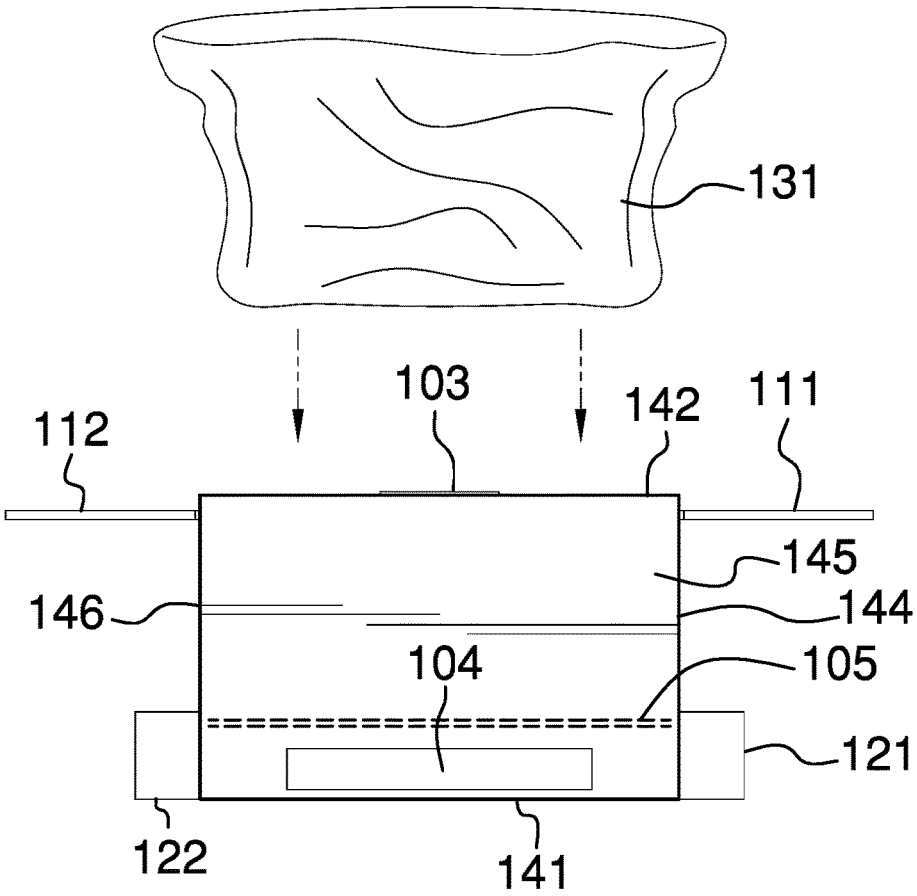
FIG. 5 is a back view of an embodiment of the disclosure.

Detailed reference will now be made to one or more potential embodiments of the disclosure, which are illustrated in FIGS. 1 through 5.

The emesis receptacle 100 (hereinafter invention) comprises a container 101, a plurality of handles 102, a one or more pockets 103, a drawer 104, a false bottom 105, and a chin extension 106. The plurality of handles 102, the chin extension 106, and the one or more pockets 103 are attached to the container 101. The drawer 104 is installed within the container 101. The false bottom 105 is mounted within the container 101. The invention 100 is a container 101 that is adapted for use in receiving and storing discharge from emesis. The invention 100 is designed to receive the discharge with a minimum of spillage. The one or more pockets 103 and the drawer 104 provide storage areas for the purpose of containing domestic articles necessary for maintaining comfort and cleanliness throughout the discharge process.

The container 101 is a first hollow rectangular box. The container 101 is further defined with a first side 141, a second side 142, a third side 143, a fourth side 144, a fifth side 145, a sixth side 146, an interior 151 and an exterior 152. The first side 141 rests upon the supporting surface 132 upon which the invention 100 is placed. The second side 142 is distal from the first side 141. The second side 142 is open such that contents can be introduced into and removed from the container 101 through the second side 142. When the second side 142 is viewed directly, the relative location of the remaining sides, in clockwise order, are the third side 143, the fourth side 144, the fifth side 145, and the sixth side 146. The third side 143 is readily identified by the installation of the chin extension 106 in the third side 143. The container 101 is the physical structure within which the discharge from emesis is contained. It is preferred that the interior 151 of the container 101 be lined with a trash can liner 131. It is preferred that volume within the interior 151 of the container 101 range between 1200 cubic inches and 1250 cubic inches such that the container 101 can be lined with a four gallon trash can liner 131.

The perimeter of the second side 142 is bounded via the third side 143, the fourth side 144, the fifth side 145, and the sixth side 146. The chin extension 106 is located in center of the portion of the third side 143 that forms the perimeter. As shown most clearly in FIGS. 1 and 3, the chin extension 106 is a sloped lip that projects away from the third side 143 in a direction away from the interior 151 of the container 101. The interior 151 surface of the chin extension 106 is bounded such that discharge landing on the interior 151 surface of the chin extension 106 will be routed into the interior 151 of the container 101. The purpose of the chin extension 106 is to contain any non-linear components of the flow of the discharge that are created by the viscosity, or variations in the viscosity, of the discharged materials.

The false bottom 105 is a surface that is mounted within the hollow interior 151 of the container 101. The surface formed by the false bottom 105 is parallel to the first side 141 of the container 101. The purpose of the false bottom 105 is to protect the contents of the drawer 104 from damage during the discharge process.

Each of the one or more pockets 103 is a storage compartment that is mounted on the side of the container 101. In the first potential embodiment of the disclosure, as shown most clearly in FIGS. 1 and 4, the one or more pockets 103 comprises a first pocket 121 and a second pocket 122. The first pocket 121 is a second rectangular box that is formed with an open surface that is parallel to and proximal to the second side 142. The first pocket 121 is mounted on the fourth side 144 of the container 101 such that the first pocket 121 rests on the supporting surface 132. The second pocket 122 is a third rectangular box that is formed with an open surface that is parallel to and proximal to the second side 142. The second pocket 122 is mounted on the sixth side 146 of the container 101 such that the second pocket 122 rests on the supporting surface 132.

The drawer 104 is a compartment that is designed to slide into and out of the container 101. The drawer 104 is positioned in the fifth side 145 such that the drawer 104 slides into and out of the container 101 in a location below the false bottom 105. Methods to form drawers 104 in containers 101 and boxes are well known and documented in the mechanical arts.

Each of the plurality of handles 102 are grips that can be used to hold and control the invention 100 during the discharge process. In the first potential embodiment of the disclosure, the plurality of handles 102 comprises a first handle 111 and a second handle 112. The first handle 111 is mounted in the fourth side 144 of the container 101 such that the first handle 111 projects away from the interior 151 of the container 101. The second handle 112 is mounted in the sixth side 146 of the container 101 such that the second handle 112 projects away from the interior 151 of the container 101. The first handle 111 further comprises a first grip 113 and a first surface 114. The first grip 113 is an aperture formed within the first surface 114 such that fingers can be wrapped around the first grip 113. The first surface 114 is a physical surface that is parallel to the first side 141 of the container 101. The second handle 112 further comprises a second grip 115 and a second surface 116. The second grip 115 is an aperture formed within the second surface 116 such that fingers can be wrapped around the second grip 115. The second surface 116 is a physical surface that is parallel to the first side 141 of the container 101. The purpose of the first surface 114 and the second surface 116 is to provide a resting surface for the arms of the user during less active periods within the discharge process.

To use the invention 100, the container 101 is lined with a four-gallon trash can liner 131. The domestic articles appropriate for use during emesis are place within the one or more pockets 103 and the drawer 104. The invention 100 is placed in a storage location. When required for use, the invention 100 is removed from storage such that the discharge can be directed into the container 101 during the discharge process. The domestic articles are used as needed through the discharge process. The loading of the one or more pockets 103 and the drawer 104 are a matter of personal preference. It is suggested that trash can liners 131 be stored with the drawer 104 and that wet wipes and tissues be stored within the one or more pockets 103. The decision to hold the invention 100 or to place the invention 100 on a supporting surface 132 during the discharge process is also a matter of personal preference. It is suggested that the invention 100 be placed on a supporting surface 132 during the discharge process when possible.

In the first potential embodiment of the disclosure, the container 101, the plurality of handles 102, the one or more pockets 103, and the chin extension 106 are formed as a single unit from molded plastic. The false bottom 105 is formed as a single unit from molded plastic. The drawer 104 is formed as a single unit from molded plastic. It is preferred that the false bottom 105 provide a water tight seal within the container that prevents the leakage of discharge into the drawer 104 should the trash can liner 131 fail. Suitable plastic includes, but is not limited to, polyethylene, polyvinylchloride, or polypropylene.

The following definitions were used in this disclosure:

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Domestic Article: As used in this disclosure, a domestic article is an item or object: 1) that is commonly found within a household; or, 2) that is commonly carried by a person. Examples of domestic articles would include, but are not limited to, trash can liners, tissues, and wet wipes.

Drawer: As used in this disclosure, a drawer is a storage compartment that is designed to slide into and out of a larger object.

Handle: As used in this disclosure, a handle is an object by which a tool, object, or door is held or manipulated with the hand.

Perimeter: As used in this disclosure, a perimeter is one or more curved or straight lines that bounds an enclosed area on a plane or surface. The perimeter of a circle is commonly referred to as a circumference.

Viscosity: As used in this disclosure, viscosity refers to the resistance of an elastic material to deformation. Higher viscosity would refer to a greater resistance to deformation.

Wet Wipe: As used in this disclosure, a wet wipe is a paper or textile is that previously moistened and that is used for cleaning purposes. By previously moistened is meant that the paper or textile is moistened before the wet wipe is packaged for storage. These previously moistened papers or textiles will remain moist until subsequent accessed. The previously moistened paper or textile can be individually wrapped for storage or can be stored in bulk.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A medical container comprising:

a container, a plurality of handles, a one or more pockets, a drawer, a false bottom, and a chin extension;

wherein the plurality of handles, the chin extension, and the one or more pockets are attached to the container;

wherein the drawer is installed within the container;

wherein the false bottom is mounted within the container;

wherein the medical container is adapted for use in receiving discharge from emesis;

wherein the medical container is adapted for use with a supporting surface;

wherein the one or more pockets and the drawer are storage areas;

wherein the container is a first hollow rectangular box;

wherein the container is further defined with a first side, a second side, a third side, a fourth side, a fifth side, a sixth side, and an interior;

wherein the first side rests upon the supporting surface;

wherein the second side of the container is distal from the first side;

wherein the container is the physical structure within which the discharge from emesis is contained;

wherein the second side of the container is a first open surface;

wherein the perimeter of the second side is bounded by the third side, the fourth side, the fifth side, and the sixth side;

wherein the chin extension is located in center of the portion of the third side that forms the perimeter;

wherein the chin extension is a sloped lip that projects away from the third side in a direction away from the interior of the container;

wherein the interior surface of the chin extension is bounded such that discharge landing on the interior surface of the chin extension will be routed into the interior of the container;

wherein the false bottom is a surface that is mounted within the hollow interior of the container;

wherein the surface formed by the false bottom is parallel to the first side of the container;

wherein each of the one or more pockets is a storage compartment that is mounted on a side of the container selected from the group consisting of the third side, the fourth side, the fifth side, or the sixth side;

wherein each of the one or more pockets comprises a second rectangular box;

wherein the second rectangular box of each of the one or more pockets is formed with a second open surface;

wherein the second open surface is the surface of the second rectangular box that is proximal to the first side;

wherein the second open surface is parallel to the first side;

wherein the drawer slides into and out of the container;

wherein the drawer is positioned in the fifth side of the container;

wherein the drawer is positioned such that the drawer slides into and out of the container in a location below the false bottom;

wherein the plurality of handles comprises a first handle and a second handle;

wherein the first handle is mounted in the fourth side of the container such that the first handle projects away from the interior of the container;

wherein the second handle is mounted in the sixth side of the container such that the second handle projects away from the interior of the container;

wherein the first handle further comprises a first surface;

wherein the second handle further comprises a second surface;

wherein the first surface is parallel to the first side of the container;

wherein the second surface is parallel to the first side of the container;

wherein the first handle further comprises a first grip;

wherein the second handle further comprises a second grip;

wherein the first grip is an aperture formed within the first surface;

wherein the second grip is an aperture formed within the second surface.

2. The medical container according to claim 1 wherein the one or more pockets comprises a first pocket and a second pocket;

wherein the first pocket is mounted on the fourth side of the container;

wherein the second pocket is mounted in the sixth side of the container.

3. The medical container according to claim 2 wherein the first pocket is mounted on the fourth side such that the first pocket rests on the supporting surface;

wherein the second pocket is mounted on the sixth side such that the second pocket rests on the supporting surface.

4. The medical container according to claim 3 wherein the false bottom is installed in the interior of the container such that the false bottom provides a water tight seal within the container.

5. The medical container according to claim 4 wherein the volume within the interior of the container ranges between 1200 cubic inches and 1250 cubic inches.

6. The medical container according to claim 5 wherein the container, the plurality of handles, the one or more pockets, and the chin extension are formed as a single unit from molded plastic;

wherein the false bottom is formed as a single unit from molded plastic;

wherein the drawer is formed as a single unit from molded plastic.

7. The medical container according to claim 6 wherein the molded plastic used to form the container, the plurality of handles, the one or more pockets, and the chin extension is selected from the group consisting of polyethylene, polyvinylchloride, or polypropylene;

wherein the molded plastic used to form the false bottom is selected from the group consisting of polyethylene, polyvinylchloride, or polypropylene;

wherein the molded plastic used to form the drawer is selected from the group consisting of polyethylene, polyvinylchloride, or polypropylene.

* * * * *